US006149518A

United States Patent [19]

Farrow

[11] Patent Number: 6,149,518

[45] Date of Patent: Nov. 21, 2000

[54] FORM/LABEL COMBINATION AND METHOD

[75] Inventor: David L. Farrow, Trenton, Canada

[73] Assignee: Moore U.S.A. Inc., Grand Island, N.Y.

[21] Appl. No.: 09/126,809

[22] Filed: Jul. 31, 1998

[30] Foreign Application Priority Data

Jul. 22, 1998 [CA] Canada ..... 2238025

[51] Int. Cl.[7] ..... B41L 5/04

[52] U.S. Cl. ..... 462/27; 283/81; 283/105; 462/21; 462/22; 462/28

[58] Field of Search ..... 283/80, 81, 105; 462/17, 21, 22, 27, 28

[56] References Cited

U.S. PATENT DOCUMENTS

| | | | |
|---|---|---|---|
| 4,159,129 | 6/1979 | Lockhart . | |
| 4,277,089 | 7/1981 | Lockhart . | |
| 4,799,712 | 1/1989 | Biava et al. . | |
| 5,129,682 | 7/1992 | Ashby | 283/81 |
| 5,209,514 | 5/1993 | Hebert | 283/81 |
| 5,254,381 | 10/1993 | Hoffman et al. | 283/81 |
| 5,279,875 | 1/1994 | Juszak et al. | 283/81 |
| 5,299,979 | 4/1994 | Ballard . | |
| 5,328,208 | 7/1994 | Garrison . | |
| 5,370,420 | 12/1994 | Khatib et al. | 283/81 |
| 5,482,753 | 1/1996 | Langan et al. . | |
| 5,533,459 | 7/1996 | Fontana . | |
| 5,580,640 | 12/1996 | Kraft et al. . | |
| 5,702,127 | 12/1997 | Korondi, Jr. | 283/81 |

*Primary Examiner*—Daniel W. Howell
*Assistant Examiner*—Monica Smith Carter
*Attorney, Agent, or Firm*—Nixon & Vanderhye PC

[57] ABSTRACT

A form/label combination provides a label and multiple receipts which may be simply constructed from two continuous sheets of paper in one pass through only a coater and a label press. The first sheet of the form/label combination provides an adhesive label on the left side, and a receipt on the right. The label is releasably attached to the left side of the second sheet, while the receipt is detachably attached to the right side of the second sheet. An image-transfer mechanism is provided between the two sheets so that images impressed on the first sheet are transferred to the second sheet. A method for manufacturing such a form/label combination is also simple and easy to practice.

20 Claims, 6 Drawing Sheets

FORM/LABEL COMBINATION AND METHOD

BACKGROUND AND SUMMARY OF THE INVENTION

The invention relates to form/label combinations, and in particular, form/label combinations such as pharmaceutical forms which may be filled out by hand or machine, to provide labels, receipts, and the like. The invention also relates to manufacturing methods for manufacturing such form/label combinations.

When a customer asks a pharmacist to fill out a prescription for a pharmaceutical, in addition to providing a receptacle containing the pharmaceutical, the pharmacist must produce an adhesive label bearing drug and dosage information to be affixed to the receptacle, as well as a receipt for the customer, and at least one other receipt for his or her own records. Similar needs also arise in other trades such as in the courier industry and the airline industry.

It is known to provide pre-printed form/label combinations, with label portions and image-transferring means, such that the user may easily produce adhesive labels, and multiple copies of a receipt. See for example, U.S. Pat. Nos. 4,277,089 and 5,299,979.

However, to produce such known form/label combinations requires multiple passes through multiple machines. Normally, at least one pass through a printing press is necessary to print information on the non-adhesive portions of the form/label combination, a pass through a coater and label press is then required to make the label and print information thereon, and finally a collating step is needed to collate the various parts of the form/label combination together.

One example of such a form/label combination is described in the second embodiment disclosed in U.S. Pat. No. 4,277,089, mentioned above. An adhesive label is affixed to a first sheet, behind which a second sheet is provided. Image-transfer means are provided between each of the label, first sheet and second sheet. Once the form/label combination has been filled out by the user, he or she is provided with one adhesive label, and two receipts. However, to produce this form/label combination requires a first step of passing the label through a coater to apply an adhesive and adhesive-release material, a second step of passing the label through a label press to die-cut the label and for preprinting of information thereon, a third step of passing at least the first sheet, and possibly the second sheet as well, through a printing press for pre-printing of information, and a fourth step of collating of the three parts—the label and the two sheets, together in a collator.

The material costs to produce such known form/label combinations are high in that at least two sheets of paper as well as a label sheet are required. Second, the equipment costs are high in that four separate machines are required to produce such form/label combinations—a coater, a label press, a printing press and a collator. Finally, the production costs are high in that at least four processing steps are required—one run through a coater, another through a label press, at least one run through a printing press, and a fourth through a collator. Thus, the production of such form/label combinations is expensive.

According to the invention a form/label combination is produced more inexpensively than present known form/label combinations, by a process which is less expensive than present known processes for producing form/label combinations.

According to a broad aspect of the invention there is provided a form/label combination comprising a first sheet having a first portion, a second portion, a front face and a back face, a second sheet located behind and substantially coextensive with the first sheet, the second sheet also having a first portion substantially coextensive with the first sheet first portion, a second portion substantially coextensive with the first sheet second portion, a front face and a back face, a first portion attachment mechanism which releasably attaches the first sheet first portion to the second sheet first portion (preferably comprising a pressure-sensitive adhesive provided on the back face of the first sheet first portion and a cooperating adhesive release material provided on the front face of the second sheet first portion), a second portion attachment mechanism which attaches the first sheet second portion to the second sheet, a mechanism (e.g. die cut) which allows ready detachment of the first sheet first portion from the first sheet second portion, and image-transfer means for transferring images impressed on the first sheet front face to the second sheet front face. The sheets and mechanisms are positioned and provided so that when information is placed on the front face of the first sheet, the first sheet first portion may be detached from the second sheet and adhered to another surface, the first sheet second portion may be detached from the second sheet to provide a separate record of the information placed thereon, and the second sheet provides a record (e.g. substantially all) of the information (indicia) placed on the front face of the first sheet.

According to another aspect of the present invention, a method is provided for making a continuous sheet of form/label combinations from a first and a second continuous sheet. The method comprises: (a) Applying image transfer means to at least one of the sheets, e.g. a coating of a self-contained image-transfer coating to a front face of the second continuous sheet, so that once the first continuous sheet is placed on top of the second continuous sheet, impressions formed on a front face of the first continuous sheet will be transferred to the front face of the second continuous sheet. (b) Applying a pressure-sensitive adhesive to a back face of a first longitudinal portion of the first continuous sheet. (c) Applying an adhesive-release coating to the front face of a first longitudinal portion of the second continuous sheet substantially coextensive with the first longitudinal portion of the first continuous sheet. (d) Placing the first continuous sheet on top of the second continuous sheet. (e) Providing longitudinal lines of weakness (e.g. perforations) in the first and second continuous sheets substantially between the first longitudinal portion and a second longitudinal portion of each continuous sheet. And, (f) providing transverse lines of weakness (e.g. perforations) in the first and second continuous sheets so as to define individual form/label combinations. In the method (a) is preferably performed before (c), and (a) through (c) are preferably performed before (d).

Advantageously, the form/label combination according to the present invention provides the user with a label and two receipts, which form/label combination may be produced from only two sheets of paper. Further, only two machines, a coater and label press, are required to manufacture the form/label combination. The form/label combination can also be produced in one pass through a coater, and another through the label press. These advantages allow the form/label combination of the present invention to be produced more inexpensively than is the case for similar known form/label combinations. Similar advantages are provided by the method of the present invention.

Other objects, features and advantages will be apparent from the following detailed description of the invention, and the appended claims.

DETAILED DESCRIPTION OF THE DRAWINGS

Figure 1:
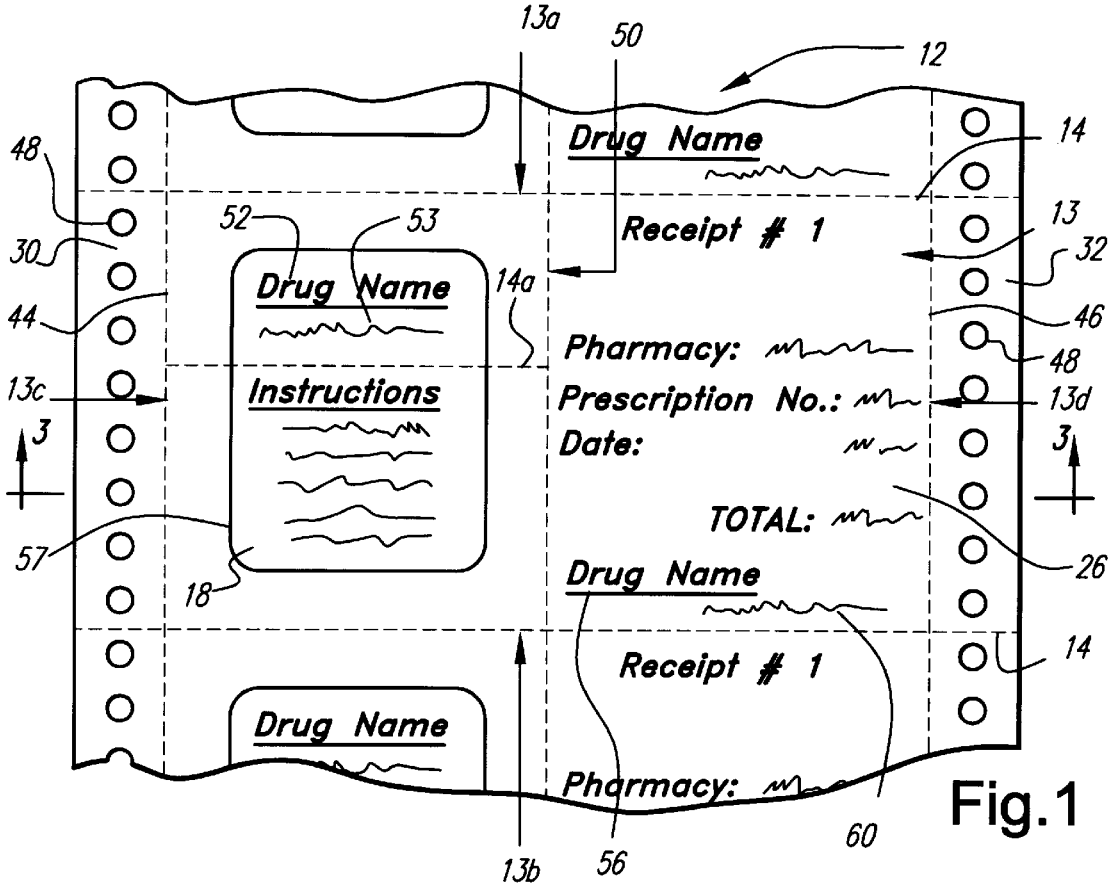
FIG. 1 is a fragmentary front view of a continuous sheet of form/label combinations according to a preferred embodiment of the present invention.
Figure 3:
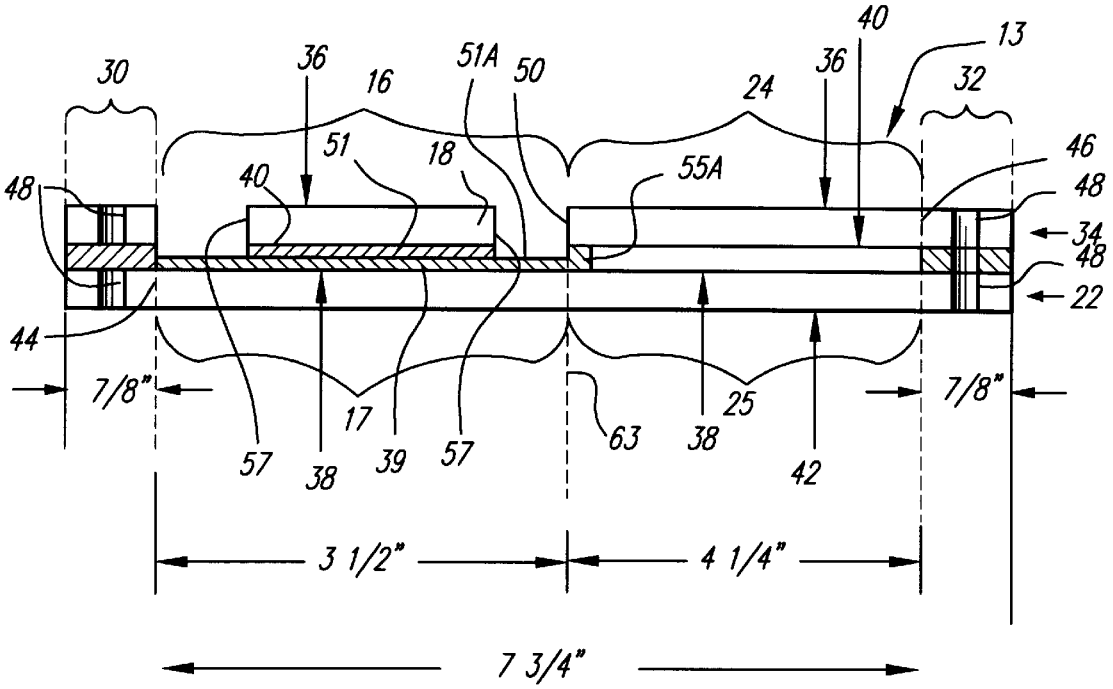
FIG. 3 is a cross-sectional view of the continuous sheet of form/label combinations taken along line 3—3 of FIG. 1, with the thickness of the form/label combination greatly exaggerated for clarity.

FIGS. 1 and 3 illustrate a continuous sheet 12 of form/label combinations according to an exemplary preferred embodiment of the present invention. The continuous sheet 12 comprises or consists of a plurality of individual preferred embodiment form/label combinations, one of which is generally identified by the number 13, releasably attached to each other by way of lines of weakness (e.g. perforations) 14, with tractor-feed margins 30 and 32 attached along each side of the continuous sheet 12. The perforations 14 allow a user to easily detach each form/label combination 13 from the continuous sheet 12. As seen in FIG. 1, each form/label combination has top 13*a*, bottom 13*b*, left 13*c* and right 13*d* edges.

As better seen in FIG. 3, each form/label combination 13 comprises a first sheet 34 having front 36 and back 40 faces, located above and substantially coextensive with, a second sheet 22 having front 38 and back 42 faces. Note that in both FIGS. 1 and 3, part of the first sheet 34 surrounding a label portion 18 has been removed for clarity of illustration. Each sheet 34 and 22 is of sufficient size to bear all information which is to be placed on the form/label combination 13. In the illustrated embodiment, each sheet 34 and 22 is approximately 7¾ inches in length from the left edge 13*c* to the right edge 13*d*, and about 3.2 inches in length from the top edge 13*a* to the bottom edge 13*b*. Each of the first 34 and second 22 sheets is constructed of an appropriate material—paper, for example—to bear the various coatings applied thereto, to allow ease of handling, and to absorb ink applied thereto by the user.

An image-transfer means is provided to transfer impressions from the sheet 34 to the sheet 22. The image transfer means may be any suitable conventional mechanism for accomplishing that purpose, such as carbon paper, CB and CF coatings, etc. In the preferred embodiment illustrated the image transfer means comprises a conventional self-contained carbonless coating 39 applied to the front face 38 of the second sheet 22, so that impressions made on the front face 36 of the first sheet 34, are transferred as indicia on the front face 38 of the second sheet 22. An example of such a carbonless image-transfer coating 39 is known by the trademark MCP, and available from Moore USA, Inc. of Lake Forest, Ill.

In FIG. 3, the dimension showing the thickness of the form/label combination 13 is greatly exaggerated to better show the different layers and coatings which make up the form/label combination. The relative thicknesses of the coatings shown in FIG. 3 are not meaningful.

In the illustrated embodiment, each of the first 34 and second 22 sheets has two conventional tractor-feed margins 30 and 32 releasably attached at the left 13*c* and right 13*d* edges, by way of lines of weakness such as perforations 44 and 46. Each tractor-feed margin 30, 32 is of sufficient width to define tractor-feed holes 48 adapted to be received by the tractor-feed mechanism of a conventional impact printer (not shown). In the illustrated embodiment, the tractor-feed margins 30, 32 are approximately ⅞ inches in width, and define a plurality of holes 48 approximately 5/32 inches in diameter, spaced 2 inches apart, and aligned in a line from the top edge 13*a* to the bottom edge 13*b* of each sheet 34 and 22, approximately ¼ inch from an outside edge of each tractor-feed margin 30 and 32. The perforations 44 and 46 allow the tractor-feed margins 30 and 32 to be readily removed from the remainder of the form/label combination 13. The tractor-feed margins 30 and 32 of the first sheet 34 are either releasably, or permanently, attached to the tractor-feed margins 30 and 32 of the second sheet 22 such that the holes 48 and perforations 44 and 46 of each of the two sheets 34 and 22 are substantially aligned.

As shown in FIG. 3, the first sheet 34 preferably comprises a first sheet first portion 16 and a first sheet second portion 24. The second sheet 22 likewise preferably comprises a second sheet first portion 17 and a second sheet second portion 25. The first sheet first portion 16 is substantially coextensive with, and is located above the second sheet first portion 17. The first sheet second portion 24 likewise is substantially coextensive with and is located above the second sheet second portion 25. In the illustrated embodiment, the two first portions (the first sheet first portion 16 and second sheet first portion 17) comprise the left sides of the two sheets 34 and 22, while the two second portions (the first sheet second portion 24 and second sheet second portion 25) comprise the right side of the two sheets 34 and 22.

The two first portions 16 and 17, are of sufficient size to bear information (indicia) to be applied to a label. In the illustrated embodiment, each of the two first portions 16 and 17 is bound by the top 13*a* and bottom 13*b* edges, the left edge 13*c*, and a vertical dividing die-cut 50 formed on the first sheet 34 about 3.2 inches from the left edge 13*c* and about 4.3 inches from the right edge 13*d*. The die cut 50 is an exemplary mechanism which allows ready detachment of the portions 16, 17 from each other.

The first sheet first portion 16 is releasably attached to the second sheet first portion 17 by a first portion attachment mechanism. The first portion attachment mechanism may comprise any conventional mechanism performing a proper attachment function in this environment, such as a coating of a pressure-sensitive adhesive 51 applied to the back face 40 of the first sheet first portion 16, which coating 51 cooperates with a layer of conventional adhesive-release material 51*a* (e.g. silicone) applied to the front face 38 of the second sheet first portion 17, to permit ready detachment of the first sheet first portion 16 from the second sheet first portion 17. The adhesive-release layer 51*a* may be applied as a coating on top of the image-transfer coating 39 on the front face 38 of the second sheet first portion 17.

Figure 2:
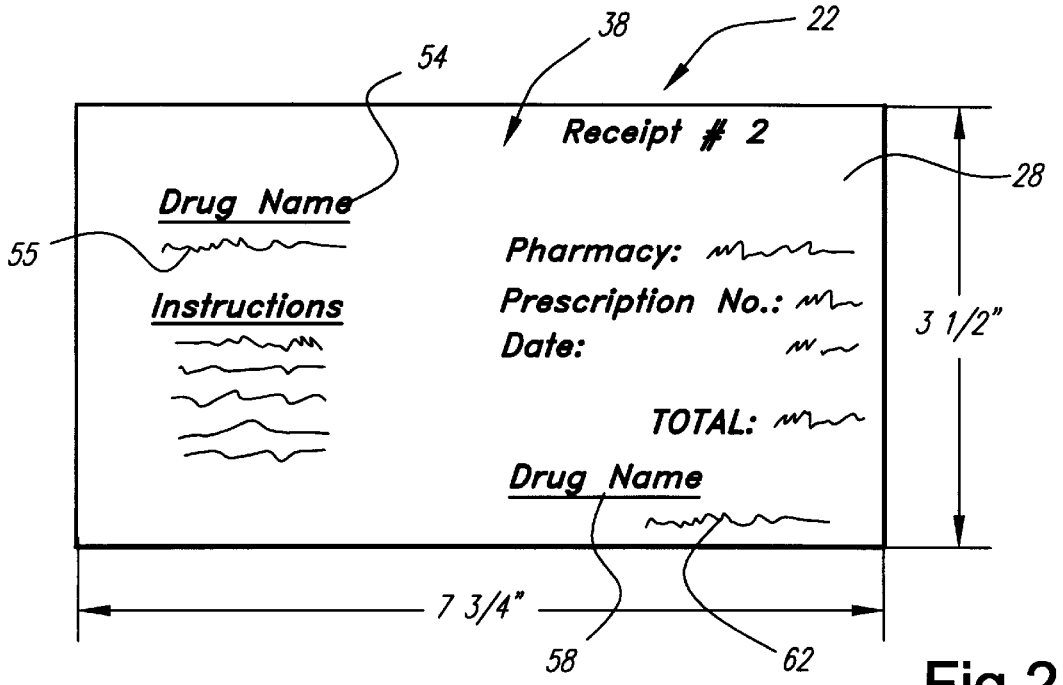
FIG. 2 is a front view of a second sheet of one form/label combination of the continuous sheet of form/label combinations of FIG. 1 with tractor-feed margins removed.

Part of the first sheet first portion 16 may be provided with a die-cut 57 to define a label 18. Further, part of the first sheet first portion 16 surrounding the label 18 may be removed as shown in FIGS. 1 and 3, or may be left in place (not shown). Indicia 52, prompting entry of variable data, such as, in the case of a pharmaceutical form, the name of the pharmaceutical, the dosage, the name of the doctor or patient, etc., may be provided on the front face 36 of the first sheet first portion 16. As shown in FIG. 2, similar, the same, or different indicia 54 may be provided on the front face 38 of the second sheet first portion 17 beneath the label 18, to correspond with information 53 which may be written, typed, or impact-printed on the label 18 by the user, which information 55 will appear on the front face 38 of the second sheet 22 by virtue of the image-transfer means (e.g. coating 39 provided on the front face 38 of the second sheet first portion 17). A horizontal line of weakness, such as perforation 14*a* (FIG. 1), may optionally be provided on either or both the first portions 16 and 17 intermediate the top edge 13*a* and the bottom edge 13*b* to allow ready separation of each of the two first portions 16 and 17 into top and bottom sections.

Each of the two second portions 24 and 25 is preferably of sufficient size to hold all of the data (indicia) which is to be placed on the first receipt. In the illustrated embodiment, the two second portions 24 and 25 are bound by the top 13*a* and bottom 13*b* edges, the right edge 13*d*, and the dividing die-cut 50. The two second portions 24 and 25 are attached by a second portion attachment mechanism, which may be any suitable conventional mechanism which accomplishes an attachment function in this environment. In the illustrated embodiment, the second portion attachment mechanism comprises a pressure sensitive adhesive 55*a* applied substantially along an approximately ¼ inch strip extending from the top 13*a* to the bottom edge 13*b* of the form/label combination 13 near the dividing die-cut 50. The second portion attachment mechanism (e.g. strip 55*a*) retains the two second portions 24 and 25 together, but the adhesive strip 55*a* is sufficiently narrow to allow a user to separate the two second portions 24 and 25 when the need arises.

Indicia 56, prompting entry of data such as, in the case of a pharmaceutical form, the name of the pharmacy, prescription number, doctor, drug, date, cost, etc. may be provided on the front face 36 of the first sheet second portion 24. Similar, identical, or different indicia 58 may be provided on the front face 38 of the second sheet second portion 25, as shown in FIG. 2, to correspond with information 60 (FIG. 1) which may be written, typed, or impact-printed on the front face 36 of the first sheet second portion 24 by the user, which information 62 (FIG. 2) will appear on the front face 38 of the second sheet second portion 25 by virtue of the image-transfer coating 39 provided on the front face 38 of the second sheet second portion 25.

A perforation or other line of weakness 63 may optionally be provided between the second sheet first portion 17 and the second sheet second portion 25 to allow ready detachment of the second sheet first portion 17 from the second sheet second portion 25.

In use, the user will fill in a form/label combination 13 as described above, with the relevant information/indicia 52, 53, 56 60. The user may handwrite the information directly onto the form/label combination, may type the information using a typewriter, may use an impact printer, or use any other suitable conventional means. In any event, as the information 53 and 60 is placed on the front face 36 of the first sheet 34, the pressure applied thereto will result in the same information/indicia being formed at 55 and 62 on the front face 38 of the second sheet 22 by virtue of the image-transfer coating 39.

Once the information/indicia 52, 53, 56, 60 has been placed on the form/label combination 13, the form/label combination 13 is detached from the continuous sheet 12 at the perforations 14. The tractor-feed margins 30 and 32 are then removed at the perforations 44 and 46, and are discarded. When the right side tractor-feed margin 32 is removed, the first sheet second portion 24 becomes separated from the second sheet second portion 25, except for the thin strip of adhesive 55*a* along the dividing die-cut 50, which still holds the two second portions 24 and 25 together. The label 18 is then removed from the second sheet first portion 17 and applied to, in the case of a pharmaceutical form, a conventional pharmaceutical receptacle (e.g. plastic vial, cardboard box, etc.), the first sheet second portion 24 is removed from the second sheet second portion 25, and, in the case of a pharmaceutical form, each of the receptacle (which now bears the label 18 showing the name of the drug, the dosage, etc.) and the first sheet second portion 24 (which bears the prescription number, cost, etc.) are given to the customer. The user may then retain the second sheet 22 which contains all the information printed on the label 18 and the first sheet second portion 24, for his or her own records.

It will be appreciated that such a form/label combination 13 may be constructed more quickly, and more economically than previous known form/label combinations. Unlike previous known form/label combinations, the present form/label combination, which provides a label 18 and two receipts comprising the first sheet second portion 24 and the second sheet 22, may be constructed using only two sheets of paper, which may be assembled and indicia applied thereto in one pass through each of a coater and a label press.

Figure 6A:
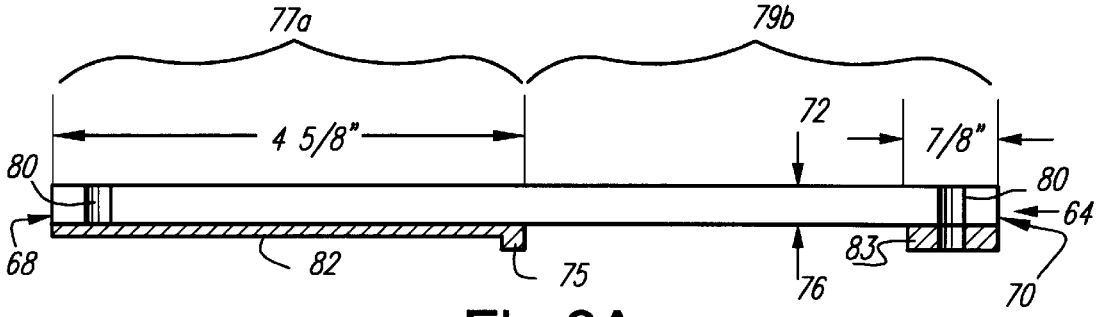
FIG. 6A is a cross-sectional view of the first continuous sheet shown in FIG. 5A, and FIG. 6B a cross-sectional view of the second continuous sheet of FIG. 5B, with pressure-sensitive adhesive and adhesive release coatings applied thereto, with the thicknesses of the sheets greatly exaggerated for clarity.
Figure 6B:
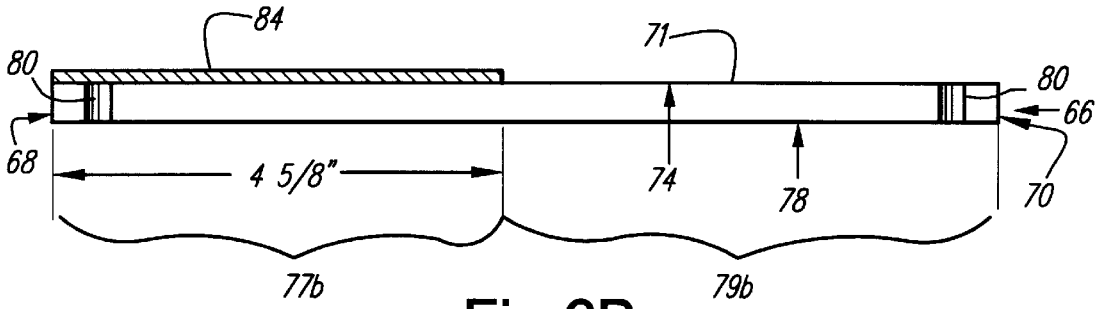
Figure 4:
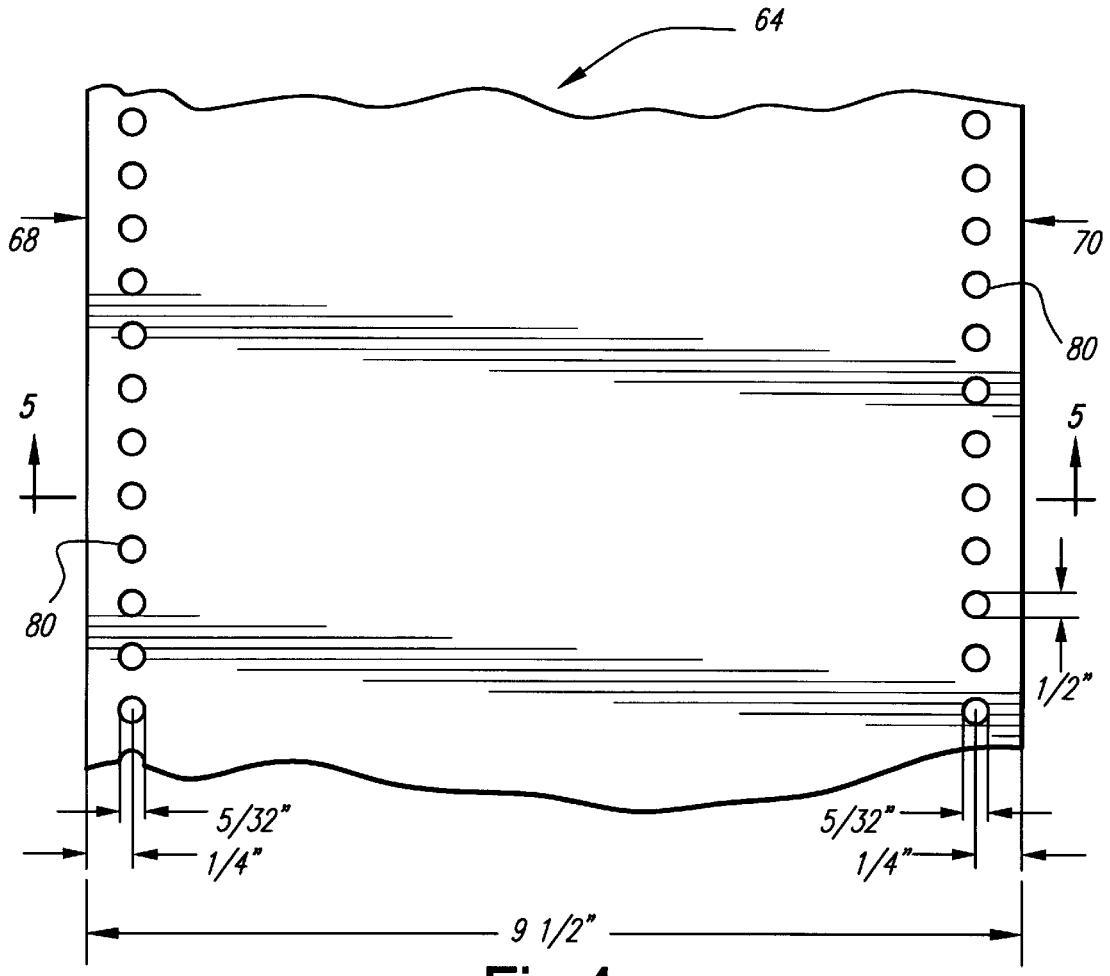
FIG. 4 is a fragmentary front view of a first continuous sheet used in an exemplary method according to the present invention.
Figure 5A:
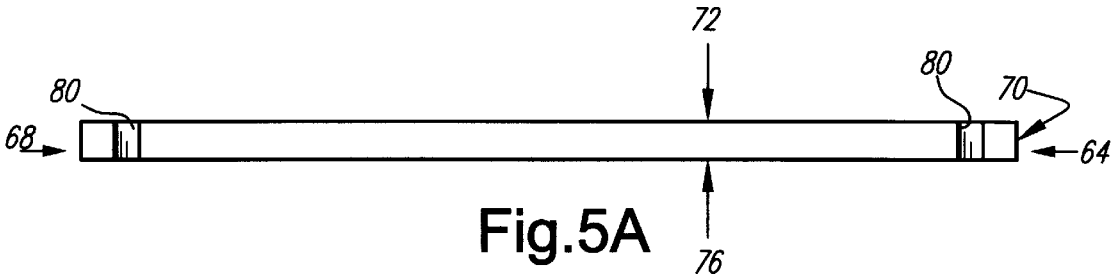
FIG. 5A is a cross-sectional view of the first continuous sheet of the ultimate form/label combination taken along line 5—5 of FIG. 4.
Figure 5B:
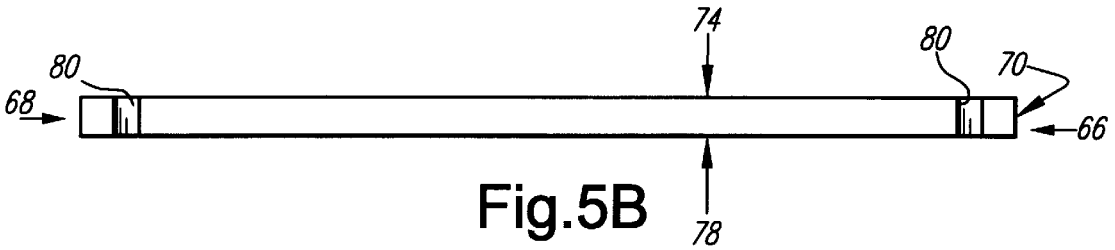
FIG. 5B is a similar view of a second continuous sheet, with the thicknesses of the sheets greatly exaggerated for clarity.

As shown in FIGS. 4 through 11, the present invention also comprises a method which may be used to construct the form/label combination 13 described above. As in FIG. 3, the dimension showing the thicknesses of the sheets and coatings in FIGS. 5, 6, 7, 9 and 11 are greatly exaggerated for clarity, and the relative thicknesses of the coatings are immaterial. The method is practiced as follows (using conventional equipment in each case):

(a) As shown in FIGS. 4 and 5A and 5B, begin with a first continuous sheet 64 having a front face 72 and a back face 76, and a second continuous sheet 66 having a front face 74 and a back face 78, each continuous sheet 64 and 66 having a left periphery 68 and a right periphery 70—in the illustrated embodiment. Each sheet 64, 66 is preferably about 9.2 inches in width, with a longitudinal column of about 5/32 inch diameter tractor-feed holes 80 spaced about 2 inches apart aligned about ¼ inch from each of the left 68 and right 70 peripheries;

(b) As shown in FIGS. 6A and 6B, apply a self-contained carbonless image-transfer coating 71 (or like image transfer means) to the front face 74 of the second continuous sheet 66 (and/or other components), such that when the first continuous sheet 64 is placed on top of the second continuous sheet 66, impressions made on the front face 72 of the first continuous sheet 64 will be transferred as indicia on the front face 74 of the second continuous sheet 66;

(c) As shown in FIGS. 6A and 7B, strip-coat the back face 76 of a first longitudinal portion 77*a* of the first continuous sheet 64 with a pressure-sensitive adhesive 82 or like attachment mechanism—in the illustrated embodiment, the first longitudinal portions 77*a* and 77*b* of each sheet 64 and 66 extend from the left periphery 68 of each sheet to a point approximately 4⅜ inches from the left edge of each sheet;

(d) Strip-coat a small portion 75 of the back face 76 of a second longitudinal portion 79*a* of the first continuous sheet 64 with a pressure-sensitive adhesive. In the illustrated embodiment, the second longitudinal portions 79*a* and 79*b* of each sheet 64 and 66 extend from the right periphery 70 of each sheet to a point approximately 4⅜ inches from the left periphery 68 of each sheet and the small portion 75 is an about ¼ inch strip between about 4⅜ inches from the left periphery to about 4⅝ inches from the left periphery.

(e) Strip-coat an area 83 on the back face 76 of the first continuous sheet 64 proximal to the column of tractor-feed holes 80 near the right periphery 70, with a pressure-sensitive adhesive. In the illustrated embodiment, this area 82 extends from the right periphery 70 to a point approximately ⅞ inches from the right periphery.

(f) Strip-coat the front face 74 of the first longitudinal portion 77*b* of the second continuous sheet 66 with an adhesive-release material (e.g. silicone) 84.

Figure 7:
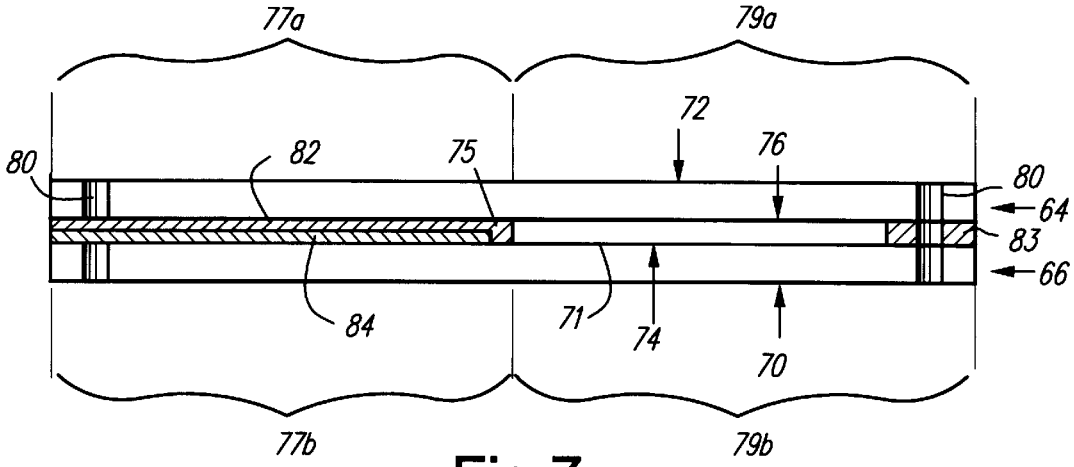
FIG. 7 is a cross-sectional view of the first and second continuous sheets shown in FIGS. 6A and 6B brought into contact with each other creating an assembled continuous sheet of form/label combinations, with the thicknesses of the sheets greatly exaggerated for clarity.

(g) As shown in FIG. 7, place the first continuous sheet 64 on top of the second continuous sheet 66.

Figure 9:
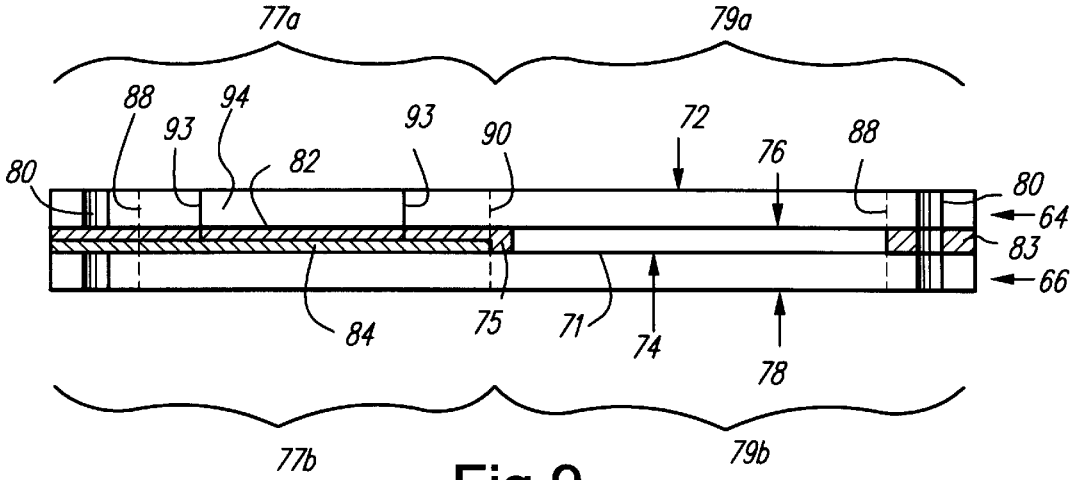
FIG. 9 is a cross-sectional view of the assembled continuous sheet of form/label combinations of FIG. 8 taken along line 9—9 of FIG. 8, with the thickness of the continuous sheets greatly exaggerated for clarity.
Figure 8:
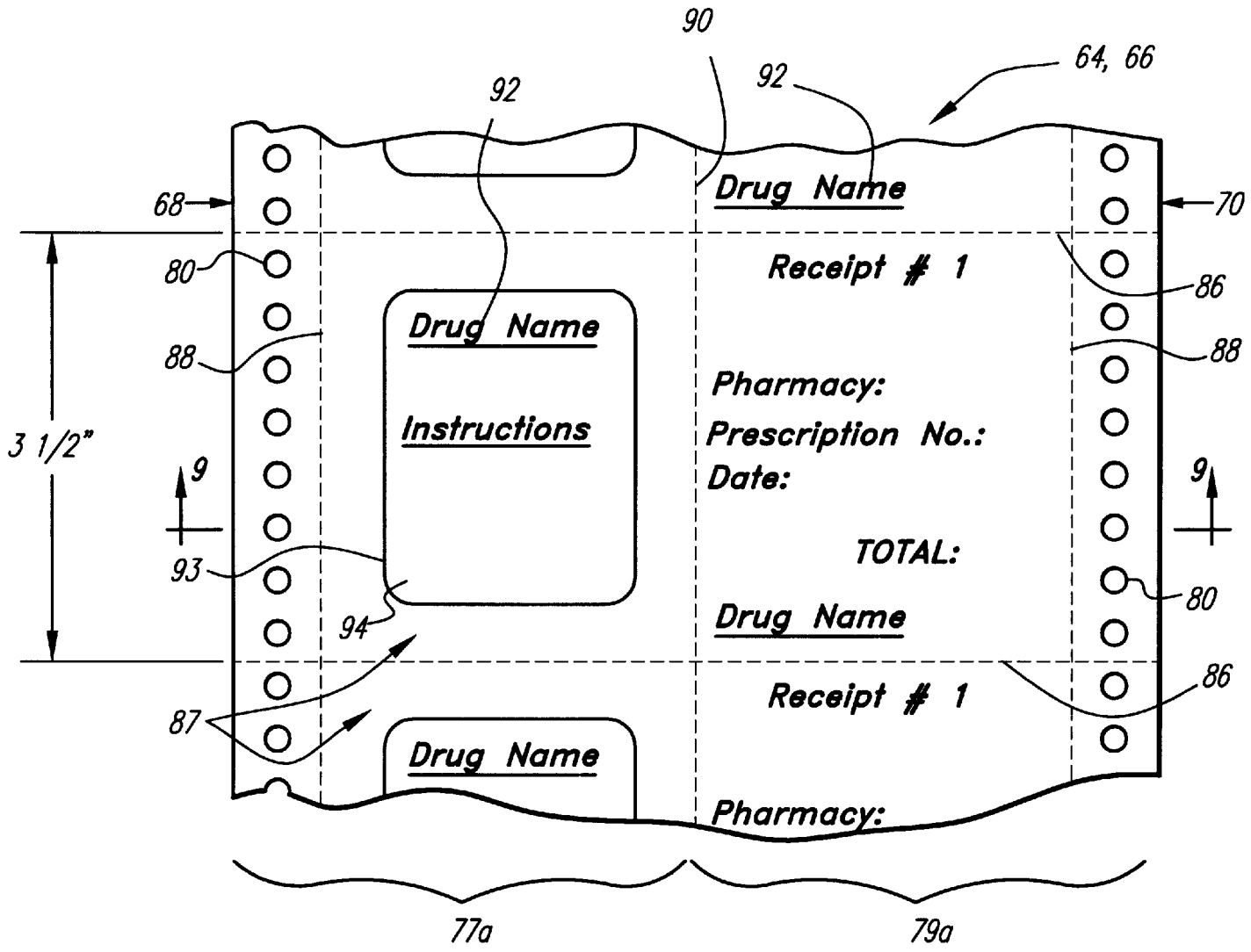
FIG. 8 is a fragmentary front view of the assembled continuous sheet of form/label combinations of FIG. 7 with perforations applied thereto, and die-cuts applied to the first continuous sheet to define labels thereon.

(h) As shown in FIGS. 8 and 9, stamp a horizontal line of perforations 86, spaced about 3.2 inches apart to form detachable form/label combinations 87.

(i) Stamp a vertical line of perforations 88, spaced about ⅞ inch from each of the left and right peripheries to form detachable tractor-feed margins.

(j) Stamp a vertical line of perforations 90, spaced about 4⅜ inches from the left edge such that each of the first longitudinal portions 77*a* and 77*b* are detachable from the second longitudinal portions 79*a* and 79*b*.

(k) Apply indicia 92 to the front face 72 of the first continuous sheet 64 of each form/label combination 87.

(l) Apply impressions to the front face 72 of the first continuous sheet 64 of each form/label combination 87 such that indicia (not shown) are formed on the front face 74 of the second continuous sheet 66 by virtue of the image-transfer coating 71.

Figure 11:
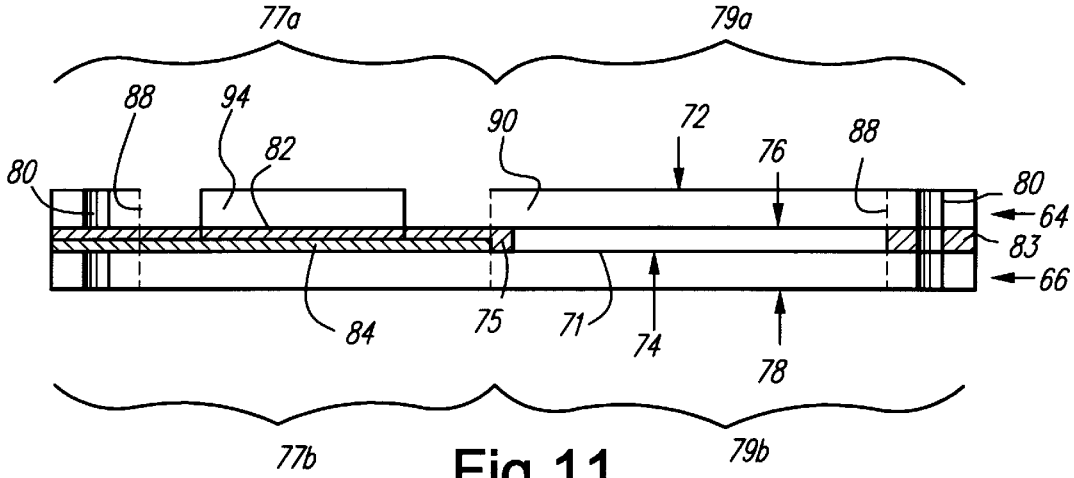
FIG. 11 is a cross-sectional view of the assembled continuous sheet of form/label combinations taken along line 11—11 of FIG. 10, with the thickness of the continuous sheets exaggerated for clarity.
Figure 10:
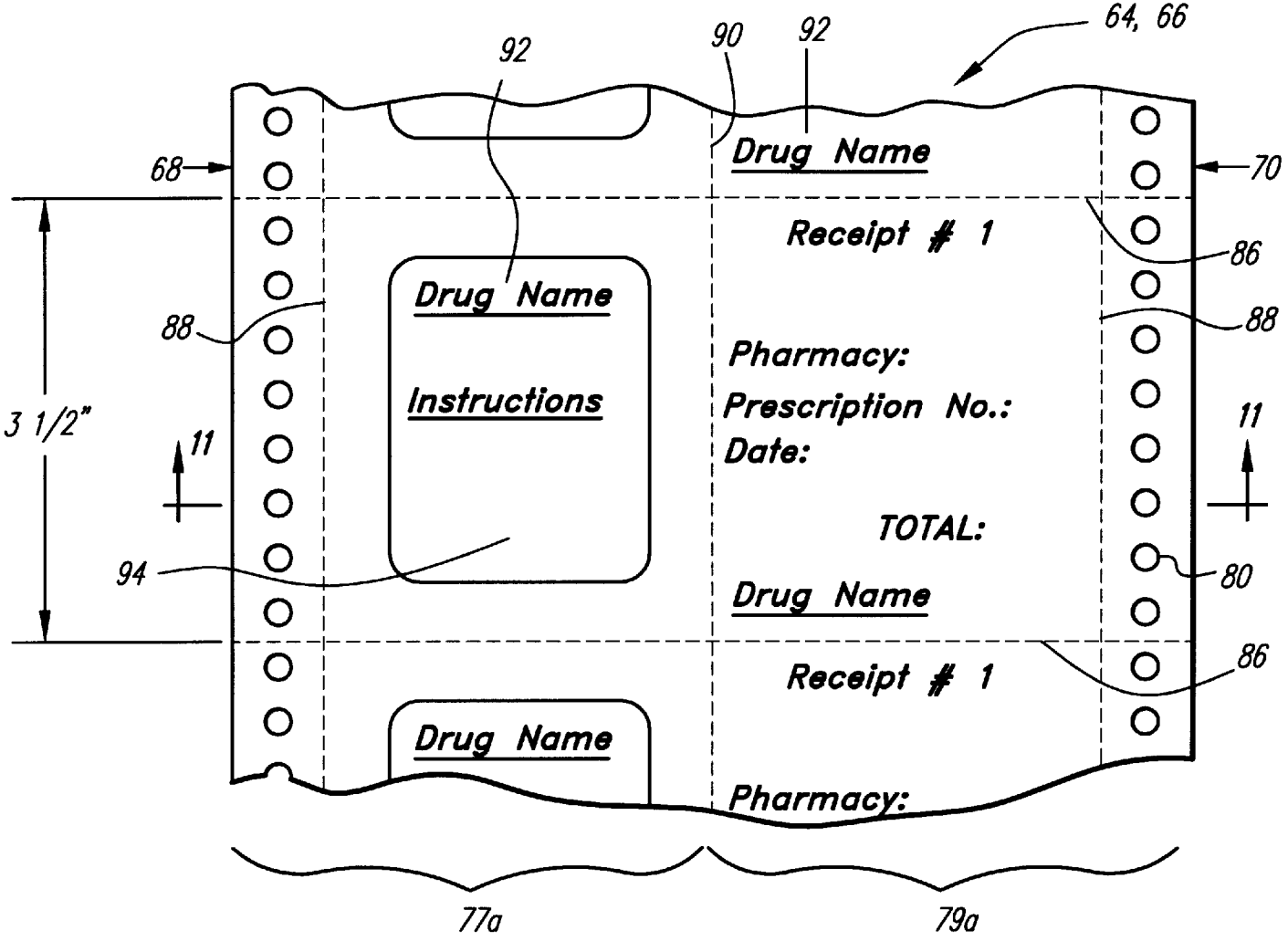
FIG. 10 is a fragmentary front view of the assembled continuous sheet of form/label combinations of FIG. 8 with a portion of the first continuous sheet surrounding the label removed.

(m) Provide die-cuts 93 to define a label 94 of an appropriate size on the first longitudinal portion 77*a* of the first continuous sheet 64 of each form/label combination 87; and (n) As shown in FIGS. 10 and 11, remove a portion of the first longitudinal portion 77*a* of the first continuous sheet 64 surrounding the label 94.

It will be appreciated that the above method acts need not necessarily be performed in the order they are described, and indeed some acts may be omitted. In the preferred method, (b) through (g) are first performed on a conventional coater (not shown), followed by (h) through (n) which are performed on a conventional label press (not shown). On the coater, the two sheets 64 and 66 are entered into the machine simultaneously. Step (b) is performed first, followed by steps (c) through (f) which are performed simultaneously. This is followed by step (g). After step (g), the sheets are entered into the label press. In the label press, steps (h) through (n) may be performed in substantially any order, though step (m) must be performed before step (n).

By practicing the above method, the continuous sheet of form/label combinations of the preferred embodiment of the invention may be constructed in one pass through each of a coater and a label press, using only two sheets of paper.

Although the form/label combination 13 according to the present invention has been described as being part of a continuous sheet 12, it is to be understood that individual form/label combinations (e.g. cut sheets) may also be constructed and used.

Although the continuous sheet 12 of form/label combinations 13 according to the present invention has been described as having tractor-feed margins 30 and 32 attached to either side, it is to be understood that a continuous sheet 12 without tractor-feed margins may also be used in some cases.

Although the first portions 16 and 17 have been shown in the drawings as being on the left side of the sheets, and the second portions 24 and 25 being on the right, it is to be understood that the first portions may be on the right side, and the second portions on the left. Alternatively, the first portions 16 and 17 may be on the top portion of the two sheets 34 and 22 and the second portions 24 and 25 on the bottom, or vice versa, etc.

Although most of the dimensions of the preferred embodiments of the present invention have been given, it is to be understood that these are only exemplary, and other dimensions may be used.

Numerous modifications, variations, and adaptations may be made to the particular embodiments of the invention described above without departing from the scope of the invention, which scope is to be accorded the broadest interpretation of the appended claims so as to encompass all equivalent structures and methods.

What is claimed is:

1. A form/label combination consisting essentially of:

a first sheet having a first portion, a second portion, a front face and a back face;

a second sheet substantially coextensive with and located behind said first sheet, said second sheet having a first portion substantially coextensive with said first sheet first portion, a second portion substantially coextensive with said first sheet second portion, a front face and a back face;

a first portion attachment mechanism which releasably attaches said first sheet first portion to said second sheet first portion;

a second portion attachment mechanism which attaches said first sheet second portion to said second sheet;

a mechanism which allows ready detachment of said first sheet first portion from said first sheet second portion;

indicia imaged on at least one of said first and second sheet front faces; and image transfer means for transferring images imposed on said first sheet front face to said second sheet front face;

said sheets and mechanisms being positioned and provided so that when information is placed on said front face of said first sheet, said first sheet first portion is detachable from said second sheet and used as a label, said first sheet second portion is detachable from said second sheet to provide a separate record of said information placed thereon, and said second sheet provides a record of said information placed on said front face of said first sheet.

2. The form/label combination according to claim 1 wherein said first attachment portion comprises a pressure-sensitive adhesive provided on said back face of said first sheet first portion; and a cooperating adhesive release material coating provided on said front face of said second sheet first portion.

3. The form/label combination according to claim 2 wherein said second sheet provides a separate record of substantially all of said information placed on said front face of said first sheet.

4. The form/label combination according to claim 1 wherein said mechanism which allows ready detachment comprises a die cut.

5. The form/label combination according to claim 1 wherein said form/label combination has top, bottom, right and left edges, said first sheet first portion extends from said top edge to said bottom edge, and from one of said left and right edges to a line intermediate said left and right edges, and said second sheet first portion substantially corresponds to said first sheet first portion.

6. The form/label combination according to claim 2 wherein said second portion attachment mechanism comp rises a strip of adhesive provided on said back face of said first sheet second portion along a line where said first sheet second portion abuts said first sheet first portion, said adhesive strip sufficiently narrow to allow a user to separate said first and second sheet second portions.

7. The form/label combination according to claim 2 wherein said first sheet first portion is provided with a die-cut defining said label.

8. The form/label combination according to claim 7 wherein said first sheet first portion consists essentially of only said label.

9. A continuous sheet comprising a plurality of form/label combinations according to claim 1 wherein each form/label combination has top, bottom, left and right edges, and is releasably attached to adjacent form/label combinations along its top and bottom edges.

10. The continuous sheet according to claim 9 wherein tractor-feed margins are releasably attached to said left and right edges of each form/label combination.

11. The form/label combination according to claim 6 wherein said adhesive strip is about ¼ inch wide.

12. A form/label combination comprising:

a first sheet having a first portion, a second portion, a front face and a back face;

a second sheet substantially coextensive with and located behind said first sheet, said second sheet having a first portion substantially coextensive with said first sheet first portion, a second portion substantially coextensive with said first sheet second portion, a front face and a back face;

a first portion attachment mechanism which releasably attaches said first sheet first portion to said second sheet first portion, said first attachment portion consisting essentially of a pressure-sensitive adhesive provided on said back face of said first sheet first portion; and a cooperating adhesive release material coating provided on said front face of said second sheet first portion;

a second portion attachment mechanism which attaches said first sheet second portion to said second sheet; and image transfer means for transferring images imposed on said first sheet front face to said second sheet front face;

said sheets and mechanisms being positioned and provided so that when information is placed on said front face of said first sheet, said first sheet first portion is detachable from said second sheet and used as a label, said first sheet second portion is detachable from said second sheet to provide a separate record of said information placed thereon, and said second sheet provides a record of said information placed on said front face of said first sheet.

13. The form/label combination according to claim 12 further comprising indicia printed on said first sheet front face.

14. The form/label combination according to claim 12 further comprising indicia printed on said second sheet front face; and wherein said second sheet provides a separate record of substantially all of said information placed on said front face of said first sheet.

15. The form/label combination according to claim 12 further comprising a die cut which allows ready detachment of said first sheet first portion from said first sheet second portion.

16. The form/label combination according to claim 12 wherein said form/label combination has top, bottom, right and left edges, said first sheet first portion extends from said top edge to said bottom edge, and from one of said left and right edges to a line intermediate said left and right edges, and said second sheet first portion substantially corresponds to said first sheet first portion.

17. The form/label combination according to claim 12 wherein said second portion attachment mechanism comprises a strip of adhesive provided on said back face of said first sheet second portion along a line where said first sheet second portion abuts said first sheet first portion, said adhesive strip sufficiently narrow to allow a user to separate said first and second sheet second portions.

18. The form/label combination according to claim 15 wherein said first sheet first portion is provided with a die-cut defining said label.

19. The form/label combination according to claim 12 wherein said first sheet first portion consists essentially of only said label.

20. A continuous sheet comprising a plurality of form/label combinations according to claim 12 wherein each form/label combination has top, bottom, left and right edges, and is releasably attached to adjacent form/label combinations along its top and bottom edges.

* * * * *